United States Patent [19]

Wurscher

[11] Patent Number: 4,858,389

[45] Date of Patent: Aug. 22, 1989

[54] APPARATUS FOR GRINDING TWIST DRILLS

[76] Inventor: Raimund Wurscher, Kramer-Glocknerstr. 12, A-1130 Wien, Austria

[21] Appl. No.: 69,827

[22] Filed: Jul. 6, 1987

[30] Foreign Application Priority Data

Jul. 7, 1986 [AT] Austria ..... 1828/86

[51] Int. Cl.[4] ..... B24B 7/00; B24B 9/00

[52] U.S. Cl. ..... 51/102; 51/209 R; 51/219 R

[58] Field of Search ..... 51/102, 209 R, 210, 51/204, 128, 129, 219 R

[56] References Cited

U.S. PATENT DOCUMENTS 2,755,601 7/1956 Lux ..... 51/209 R 4,574,529 3/1986 Wurscher ..... 51/128

*Primary Examiner*—Frederick R. Schmidt

*Assistant Examiner*—Maurina Rachuba

*Attorney, Agent, or Firm*—Kurt Kelman

[57] ABSTRACT

Apparatus for grinding twist drills comprises a drive shaft and a grinding wheel, which is coupled to said shaft and is mounted thereon to be axially movable and tiltable relative to the shaft and is spring-loaded toward a drill-guiding structure facing the grinding surface of the grinding wheel. The drill-guiding structure comprises guiding passages for guiding drills differing in diameter against the grinding surface and in association with each grinding passage comprises at least one guide lug for extending into a flute of a twist drill extending through the associated guiding passage, and a drill stop for limiting the advance of the twist drill in the guiding passage against the elastically yielding grinding wheel. To the drill-guiding structure a plurality of peripherally spaced apart abutments are connected which are engageable by the grinding surface and have a higher hardness than the grinding wheel, the abutments limiting the displacements of the grinding surface toward the drill-guiding structure under spring force in an end position in which the grinding surface is closer to the guide lugs than the drill stop. The grinding surface is interrupted by openings in that one area which will be in contact solely with clearance surfaces of those twist drills receivable in the apparatus which have a larger diameter. The provision of said openings completely prevents the formation of a groove in the grinding surface and ensures a high grinding action of said interrupted area of the grinding surface.

2 Claims, 3 Drawing Sheets

FIG.1
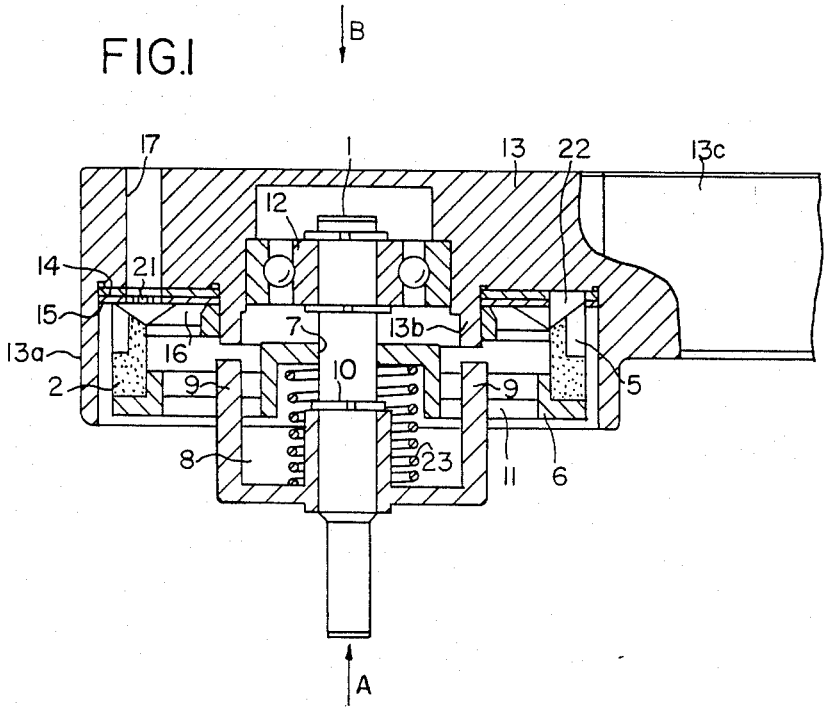
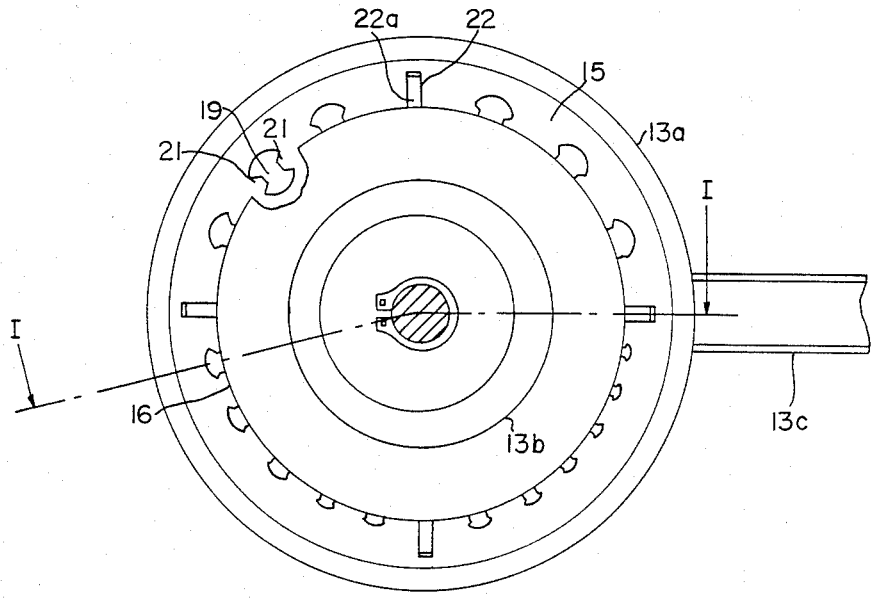
FIG.2

APPARATUS FOR GRINDING TWIST DRILLS

BACKGROUND OF THE INVENTION

1. Field of the Invention

This invention relates to apparatus for grinding twist drills each having two clearance surfaces and a helical flute associated with each clearance surface, when apparatus comprises a rotatable drive shaft, a grinding wheel having a grinding surface and axially movably and tiltably mounted on and coupled to said drive shaft and spring biased toward a drill-guiding structure, which faces said grinding surface and has guiding passages differing in diameter and adapted to guide respective ones of said twist drills differing in diameter toward said grinding surface until the latter engages such twist drill at one clearance surfaces thereof, also comprising in alignment with each of said guiding passages at least one guide projection for extending into a flute of a twist drill extending through said guiding passage, and a drill stop means for engaging a twist drill extending through said guiding passage at the other clearance surface thereof so as to limit the advance of said twist drill toward the resiliently yielding grinding surface, said drill-guiding structure also comprising a plurality of abutments each having an abutment surface which is engageable by the grinding surface in an end position in which said grinding surface is closer to the guide projections than the drill stop means.

2. Description of the Prior Art

Such apparatus in which twist drills can be ground without being chucked are known from U.S. Pat. No. 4,574,528.

In a preferred embodiment of such known apparatus the axes of the guiding passages are parallel with and at an equal distance from the drive shaft and are meeting the inner rim of the angular internal conical ginding surface. That clearance surface of a drill being ground which does not engage the drill stop means will be forced against the grinding surface so that the spring-biased grinding wheel will be clear of those abutments which are closest to the twist drill but the grinding wheel will still be forced by the spring against the abutments which are diametrically opposite to the drill so that the grinding surface should be continuously restored to the desired shape during the grinding of a twist drill. It is expected that thereby no groove will be formed in the grinding surface during a prolonged grinding of twist drills which are so small in diameter that they will not contact the entire grinding surface during a revolution of the grinding wheel.

However, in such known apparatus which has abrasive grains of alumina in the grinding wheel and abutments of cemented carbides, the restoration of the original shape of the grinding surface will not always be completely maintained, especially if the difference in diameter between the smallest and the largest drill receivable in the apparatus will exceed a critical magnitude and if predominantly the smallest drills are ground. The reasons are that the abrasion of the wheel is essentially proportional to the pressure exerted onto its grinding surface. This pressure is highest in case of the smallest drill engaging the grinding surface. Hence, in order to prevent the formation of a groove in the grinding surface, the pressure between the abutment surfaces of the abutments and the grinding surface has to be at least as high as the pressure between the smallest drills and the grinding surface. To achieve this, the size of the abutment surfaces and hence their width would have to be so much reduced that abutments of cemented carbides would be worn considerably faster in the axial direction of the grinding wheel, which would considerably reduce the apparatus' durability.

In order to be able to explain a further disadvantage of the known apparatus, there has to be explained a disadvantage inherent in the grinding method under consideration.

The spring power, by which the grinding surface is urged against the clearance surface of the twist drill, is equal at all drill diameters. Consequently, the grinding pressure and hence of the grinding action in the direction of the axes of the drill (the axial grinding action) decreases with increasing drill diameter proportionally to the square of the drill diameter. Since the desired symmetrical point of the drill is achieved by grinding both clearance surfaces for an equally long time, time imperfections would cause relatively large deviations from a symmetrical drill point, when the axial grinding action is high. Consequently, the problem arises that at a spring power adapted for the smallest drills, the axial grinding action at the largest drills would be so low that an undesired long grinding procedure would be necessary for those largest drills.

Further, if in the known apparatus mainly small drills will be ground, there arises, as explained before, at least a slight groove in the corresponding area of the grinding surface, whereby the abutments loose contact with this area. In that area of the grinding surface which is not in contact with those small drills, the abutments not only wear out but also dull the grains in the grinding surface. Consequently, there arises an area of the grinding surface worn out by the smaller drills and having sharper grains, hence higher axial grinding action, and another area worn out by the abutments and having dulled grains, hence lower axial grinding action. However, because of the special geometry of twist drills it is the latter area in which the larger part of the material, which has to be ground away from these larger drills, is located. Consequently, this dulling effect of the abutments provides an additional and essential reduction of the axial grinding action just for those drills, namely the larger ones, for which already this grinding method leadsto a reduced axial grinding action. Indeed, in the U.S. Pat. No. 4,574,528 means reducing this dulling effect are provided. but these means increase the inclination for groove formation.

SUMMARY OF THE INVENTION

It is an object of the invention to provide apparatus which is of the kind described first hereinbefore and in which a continuous and complete restoration of the original shape of the grinding surface will be automatically obtained, independent of the diameter of the drills being ground.

It is another object of the invention to provide apparatus which is of the kind described hereinbefore and in which a higher axial grinding action will be obtained in that one area of the grinding surface which will be in contact only with the larger drills receivable in the apparatus, and in which a lower axial grinding action will be obtained in that one area of the grinding surface which will be in contact also with the smaller drills receivable in the apparatus.

In accordance with the invention these objects are accomplished by openings in the grinding surface interrupting that one area of the grinding surface which will be in contact solely with clearance surfaces of those twist drills receivable in the apparatus wich have a larger diameter.

In accordance with the invention such openings may be obtained by notches in the grinding wheel.

It could be shown in an apparatus according to the invention which has been adapted for the grinding of twist drills within a diameter range of 2,5 mm:s to 10 mm:s, that at a proper rotational extension (that means the extension in the rotary direction of the grinding wheel), at a proper number and a proper radial extension of the openings, a continuous and complete restoration of the original shape of the grinding surface can be obtained, even then, if only small drills are ground in the apparatus.

The action of the openings in the grinding surface can be explained thereby, that the margins of the openings constitute weak lines along which a faster break off of the abrasive grains of the grinding wheel will occur. This margin action spreads out over at least a part of each interface between the openings.

Consequently the rotational extension of those interfaces should not be larger than the sum of the rotational extensions of the margin actions of two adjacent margins of the openings.

Hence the proper number and the proper rotational extension of the openings are those ones, which result in such a rotational extension of the interfaces, which is just small enough to prevent the formation of a groove in the grinding surface when only small drills are ground.

Concerning the rotational extension of the openings there have to be considered two further demands. The rotational extension of the openings should not be smaller that the rotational extension of the abutments, since the margin action described above is most effective when the abutments can sink into the openings. On the other side, it should not be essentially larger, since otherwise, the reduction of the grinding surface and consequently of the amount of grinding material in the interrupted area would be unnecessary large.

Hence, the rotational extension of the openings can be considered to be given, whereas the proper number of openings should be found empirically, espcially since for that even such determinants are grain quality, grain size and hardness of the grinding wheel are of importance. As to the grain quality it appeared that so called normal corundum is especially appropriate, since it needs a smaller number of openings as for instance high-quality corundum.

In the above identified apparatus a radial extension of the openings of about two two thirds of the radial extension of the grinding surface appeared to be a particularly suitable one.

In such apparatus it also appeared that the dulling effect of the abutments upon the grains of the grinding surface will be reduced in the interrupted area of the grinding surface, and that this effect will increase with increasing number of openings. In other words, the grinding surface becomes sharper within its interrupted area with increasing number of openings. Hence smaller drills can be ground within an area of the grinding surface having a lower axial grinding action, whereas that portion of the clearance surface of larger drills where the largest amount of material is located can be ground within an area having a higher axial grinding action.

BRIEF DESCRIPTION OF THE DRAWING

FIG. 1 is a longitudinal sectional view taken on plane I—I' in FIG. 2 and showing apparatus embodying the invention.

FIG. 2 is a top plan view taken in the direction of the arrow A in FIG. 1 and showing the drill-guiding structure.

Detailed description of the preferred embodiment

Figure 3:
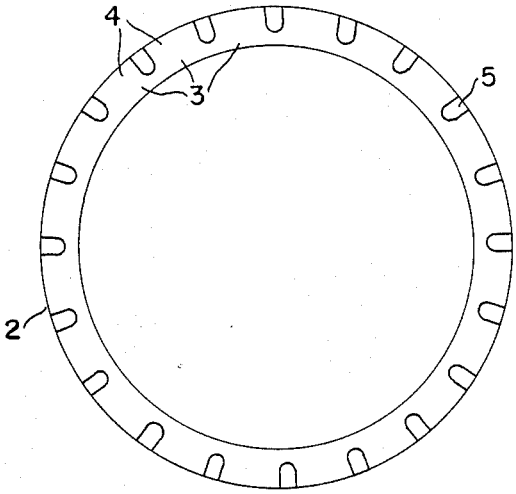
FIG. 3 is a top plan view taken in the direction of the arrow B in FIG. 1 showing the grinding surface of the grinding wheel.

An illustrative embodiment of the invention will now be described in more detail with reference to the drawing.

With reference to the drawing, a drive shaft 1 is adapted to be gripped in the chuck of a drilling machine, not shown.

The grinding wheel 2 has the shape of a hollow cylinder whose upper end is formed as an inwardly beveled grinding surface 3,4. The radial extension of the grinding surface 3,4 corresponds to the radius of the largest drill receivable in the grinding apparatus. The grinding wheel 2 has notches 5 which extend from the periphery inwardly and interrupt the grinding surface. Their radial extension is about two thirds of the radial extension of the grinding surface 3, 4. Consequently, the grinding surface consists of an inner non interrupted area 3 and an outer interrupted area 4 consisting of the interfaces between the notches 5.

The grinding wheel 2 is adhesively bonded to a grindingwheel carrier 6, which has a bore that is coaxial to the grinding surface 3, 4. The shaft 1 extends through the bore 7 and is only slightly smaller in diameter than the bore 7 so that the grinding wheel 2 is mounted on the shaft 1 to be axially movable and tiltable relative to the shaft 1.

A coupling element 8, 9 comprises a cup-shaped member 8 having a central bore through which the shaft 1 extends with a friction fit to retaining ring 10 secured to the shaft 1. The coupling element also comprises two coupling arms 9, which protrude upwardly from the rim of the cup and are parallel to the shaft and extend with play through respective eccentric openings 11 in the grinding-wheel carrier 6.

The drive shaft 1 is rotatably mounted by means of a ball bearing assembly 12 in a drill-guiding structure comprising rigidly connected elements 13 to 16.

The element 13 consists of a body formed with cylindrical guiding passages 17 (FIGS. 5, 6 and 9), which have different diameters and are adapted to guide drills differing in diameter toward the grinding surface 3, 4. The axes of the guiding passages 17 are located in an imaginary cylindrical surface, which is coaxial with shaft 1 and has a diameter that is approximately as large as the diameter of the cylindrical inside surface of the grinding wheel 2. The body 13 also comprises a hollow cylindrical extension 13*a*, which surrounds the grinding wheel 2. A handle 13*c* protrudes laterally from the body 13.

A guide lug carrier 14, 15 and a drill stop 16 are friction fit in the hollow-cylindrical extension 13*a* of the body 13.

The guide-lug carrier 14, 15 consists of two plates 14 and 15, which are rigidly interconnected. The plate 14 is formed with bores 18, which are aligned with respective guiding passages 17 and are equal in diameter to the corresponding guiding passages 17. The plate 15 has openings 19 aligned with respective bores 18. Two guide lugs 21 project into each opening 19 and are arranged to extend with an angular play into respective flutes 20 of a twist drill which extends through the associated guiding passage 17.

The drill stop 16 is frustoconical and has a conical stop face.

Four abutments 22 (FIGS. 1, 2, 7 and 8) which are engageable by the grinding wheel 2 are soldered to the guide-lug carrier 14, 15 and consist of a material that has a higher abrasive hardness than the grinding wheel 2, particularly of cemented carbides. The abutments 22 face the grinding surface 3, 4 and are regularly spaced apart in the peripheral direction thereof. Each abutment 22 is formed with abutment surfaces 22*a*. The abutment surfaces 22*a* face and are parallel to the grinding surface 3, 4. The abutment surfaces 22*a* have a smaller axial spacing from the guide lugs 21 than the stop face of the drill stop 16.

A spring 23 bears at one end against the bottom of the coupling element 8, 9 and at its other end against the grindingwheel wheel carrier 6 and urges the grinding surface 3, 4 of the grinding wheel 2 toward the abutment surfaces 22*a* of the abutments 22. In engagement with the abutments 22, the grinding surface 3, 4 will be closer to the guide lugs 21 than the stop face of the drill stop 16.

The embodiment described hereinbefore has the following mode of operation:

The shaft 1 is chucked in the chuck of a hand-held electric drilling machine. The resulting assembly is held by means of one hand at the handle 13c. Then the drilling machine is started. The twist drill to be ground is pushed with the other hand into the narrowest guiding passage 17 which can receive the drill and is moved to extend between the guide lugs 21 associated with said guiding passage 17 until one clearance surface 24 of said twist drill bears on the drill stop 16. Then the drill is caused to perform a plurality of angular oscillations between the guide lugs 21. Thereafter the twist drill is axially retracted from the guide lugs 21 and is then rotated through 180° and the procedure described hereinbefore is repeated to grind that clearance surface 24 of the drill which has previously engaged the drill stop 16. The two grinding cycles which have been described hereinbefore may be repeated until the drill has been ground as desired. Thereafter the drilling machine is turned off.

Figure 7:
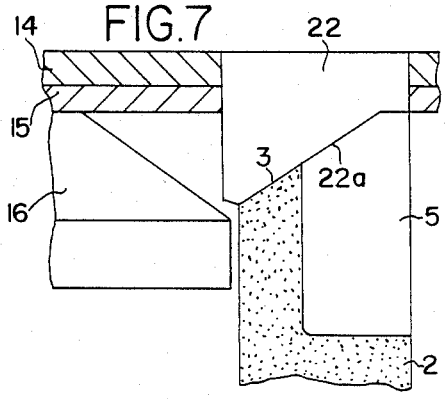
FIG. 7 is a sectional view which is similar to FIG. 6, but shows the structure adjacent to an abutment which is diametrically opposite to the inserted twist drill, at that moment of rotation of the grinding wheel where one of its notches is underneath the the abutment.
Figure 8:
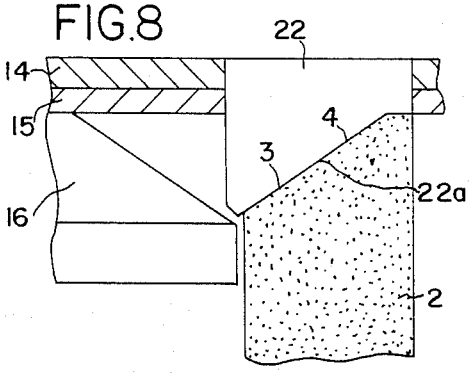
FIG. 8 is a sectional view which is similar to FIG. 7, but at that moment of rotation of the grinding wheel where one of its interfaces is underneath the abutment.

During the grinding operation that clearance surface 24 of the drill which does not bear on the drill stop 16 forces the resiliently yielding grinding wheel 2 away from the nearest adjacent abutments 22 (FIGS. 5, 6 and 9) while the grinding wheel 2 is still forced by the spring 23 against and will be worn in contact with those abutments 22 which are more or less diametrically opposite to the twist drill being ground (FIGS. 7 and 8). As a result, the axial wear of the grinding wheel 2 caused by the abutments 22 within the area 4 of the grinding surface should be as large as the axial wear of the grinding wheel 2 caused by smaller twist drills within the area 3 of the grinding surface.

In an embodiment of the invention wherein the rotational extension of the interfaces in area 4 of the grinding surface is sufficiently small, the rotational extension of the notches 5 corresponds to the width of the abutments 22 and the radial extension of the notches 5 is convenient, even when solely small drills are ground a continuous and complete restoration of the original shape of the grinding surface 3, 4 is obtained.

Figure 4:
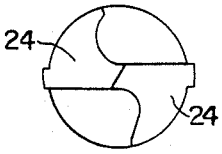
FIG. 4 is a top plan view of the point of a conventional twist drill.
Figure 5:
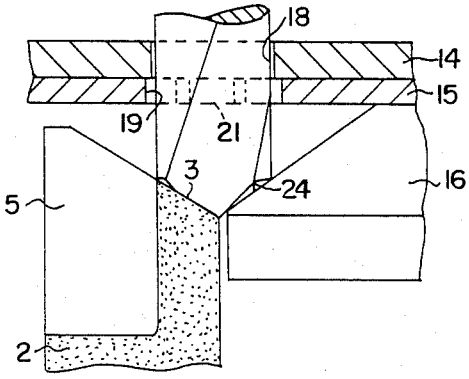
FIG. 5 is an enlarged fragmentary longitudinal sectional view showing respective portions of the drill-guiding structure and grinding wheel of apparatus as shown in FIG. 1, adjacent to a guiding passage having a small diameter, and also shows a twist drill that has been inserted through said guiding passage and is being forced against the drill stop means, at that moment of rotation of the grinding wheel where one of its notches is located beneath the point of the inserted drill.
Figure 6:
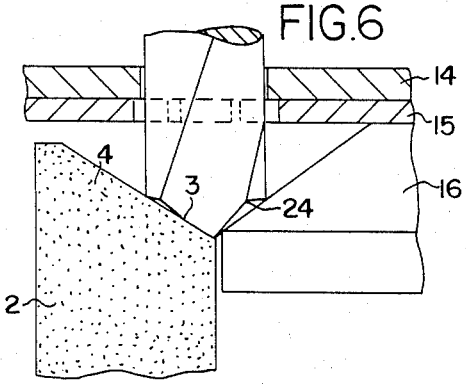
FIG. 6 is a sectional view which is similar to FIG. 5 but at that moment of rotation of the grinding wheel where one of the interfaces of the grinding surface is located beneath the point of the inserted drill.
Figure 9:
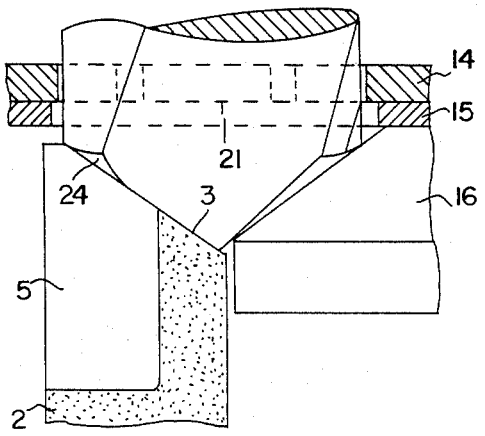
FIG. 9 is a sectional view which is similar to FIG. 5, but is adjacent to that guiding passage having the largest diameter.

Further, in such an embodiment the bluntness of the grains in the grinding surface, caused by the abutments 22, is less within area 4 than within area 3 and decreases in area 4 with an increasing number of notches 5. FIGS. 4, 5 and 9, clearly show that a larger portion of the clearance surface 24 of the largest drill receivable in the apparatus will be ground within area 4, consequently within an area having a higher axial grinding action, whilst the whole clearance surface 24 of a small drill will be ground within area 3 of the grinding surface, consequently within an area having a lower axial grinding action.

An illustrative embodiment of the invention has been described hereinbefore but the invention is by no means restricted to that embodiment.

The illustrative embodiment which has been described is designed as an attachment for a hand-held drilling machine.

Alternatively, the invention might be embodied in a self-contained unit which incorporates a motor.

The invention also relates to a grinding wheel according to the invention and including the grinding-wheel carrier, which is made as replacement part for embodiments according to the invention.

What is claimed is:

1. An apparatus for grinding a twist drill having two clearance surfaces and two helical flutes associated with respective ones of said clearance surfaces, which comprises (a) a rotatable drive shaft, (b) a grinding wheel having an annular grinding surface a concentrically surrounding the drive shaft and comprised of a continuous inner area and an adjoining outer area, only the outer grinding surface area having peripherally spaced interruptions, the grinding wheel being axially movably and tiltably mounted on, and coupled to, said drive shaft for rotation thereby, (c) a drill guiding structure axially spaced from said grinding surface, the drill guiding structure defining (1) a plurality of peripherally spaced guiding passages of different diameters for respectively receiving twist drills of smaller and larger diameters, each one of the grinding passages having one open end spaced from, and facing, said grinding surface and an opposite end adapted to receive a respective one of the twist drills in a position in which one of said clearance surfaces of said twist drill of a smaller diameter contacts only said inner grinding surface area while one of said clearance surfaces of said twist drill of a larger diameter contacts the inner and outer grinding surface areas, and the drill guiding structure comprising (2) at least one guiding projection in axial alignment with each one of said guiding passages near said one end thereof, the guiding projection being adpated to extend into one of said flutes of said twist drill received in said guiding passage and holding said twist drill against rotation, (3) drill stop means having stop surface portions axially aligned with, and facing, respective ones of said guiding passages, the stop suface portions being engageable by the other clearance surface of said twist drill received in said guiding passage to limit the advance of said twist drill towards said grinding surface, and (4) a plurality of peripherally spaced abutments having an abutment surface of a material having a greater hardness than the grinding surface, and (d) spring means urging said grinding wheel towards said drill guiding structure, (1) each abutment surface being engageable by the grinding surface and arranged to limit the spring-urged movement of the grinding surface in an end position in which said grinding surface is closer to the guide projection than to the drill stop means.

2. In the grinding apparatus improvement of claim 1, the grinding surface interruptions being defined by notches along the periphery of the grinding wheel.

* * * * *